United States Patent [19]

Drabowitch et al.

[11] Patent Number: 4,713,663

[45] Date of Patent: Dec. 15, 1987

[54] GUIDED VEHICLE CONTROL PROCESS AND APPARATUS

[75] Inventors: Serge Drabowitch, Chatenay Malabray; Michel Baril, Lesigny; Guy Le Parquier, Paris, all of France

[73] Assignee: Thomson-CSF, Paris, France

[21] Appl. No.: 802,352

[22] Filed: Nov. 27, 1985

[30] Foreign Application Priority Data

Nov. 30, 1984 [FR] France ..... 84 18328

[51] Int. Cl.[4] ..... G01S 13/88; B61L 3/12

[52] U.S. Cl. ..... 342/70; 342/188; 342/104

[58] Field of Search ..... 342/70, 188, 104, 115

[56] References Cited

U.S. PATENT DOCUMENTS

| | | | |
|---|---|---|---|
| 3,426,349 | 2/1969 | Gareis | 342/70 X |
| 3,787,679 | 1/1974 | Birkin | 246/30 |
| 4,012,736 | 3/1977 | Angwin | 342/115 X |
| 4,016,566 | 4/1977 | Fujiki | 342/71 X |
| 4,319,245 | 3/1982 | Mawhinney | 342/104 |
| 4,339,753 | 7/1982 | Mawhinney | 342/104 X |

*Primary Examiner*—T. H. Tubbesing

*Attorney, Agent, or Firm*—Oblon, Fisher, Spivak, McClelland & Maier

[57] ABSTRACT

The apparatus according to the invention relates to a guided vehicle control process and apparatus which comprises passive beacons, as well as radars permitting the detection thereof. The presence or absence of a beacon permits the automatic control of a train, e.g. with a view to automating the driving thereof. The apparatus according to the invention uses retrodirectional beacons and/or beacons inducing a polarization rotation of the radiation received. The use of retrodirectional beacons induces a change of frequency by Doppler effect of the reflected radiation. The change of the Doppler frequency and/or the polarization rotation of the radiation improves the signal-clutter ratio and/or the separation of the transmission and reception channels.

13 Claims, 9 Drawing Figures

GUIDED VEHICLE CONTROL PROCESS AND APPARATUS

BACKGROUND OF THE INVENTION

1. Field of the Invention

The present invention mainly relates to an apparatus for the control of guided vehicles, e.g. trains, as well as to a process for the automatic control or driving thereof.

2. Discussion of Background

Driving a guided vehicle requires the knowledge of a large volume of information, part of which is linked with the geographical location of the vehicle. Thus, for example, an optimum train speed corresponds to a particular portion of the track.

SUMMARY OF THE INVENTION

The apparatus according to the present invention has signalling devices distributed along the track followed by the vehicle, as well as means for the detection of the signaling means. The detection means can be coupled to automatic processing means, e.g. controlling the speed of the train, the opening or closing of doors, the switching on or off of lights or the voice synthesis of a message. In the case of the present invention, the signalling means are passive beacons able to reflect a characteristic signal when illuminated by an ultra-high frequency energy beam. The means for detecting the signalling devices are e.g. low power radars.

The invention more particularly relates to an apparatus for controlling guided vehicles having electromagnetic wave reflecting beacons fixed to the track and means for detecting said beacons fixed to the vehicle, wherein the radiation axis of the transmitting antenna has a non-zero angle $\theta$ with the plane perpendicular to the velocity or speed vector of the vehicle.

BRIEF DESCRIPTION OF THE DRAWINGS

The invention is described in greater detail hereinafter relative to non-limitative embodiments and the attached drawings, wherein there is shown:

In FIGS. 1 to 9 the same references are used for designating the same elements.

DETAILED DESCRIPTION OF THE PREFERRED EMBODIMENTS

Figure 1:
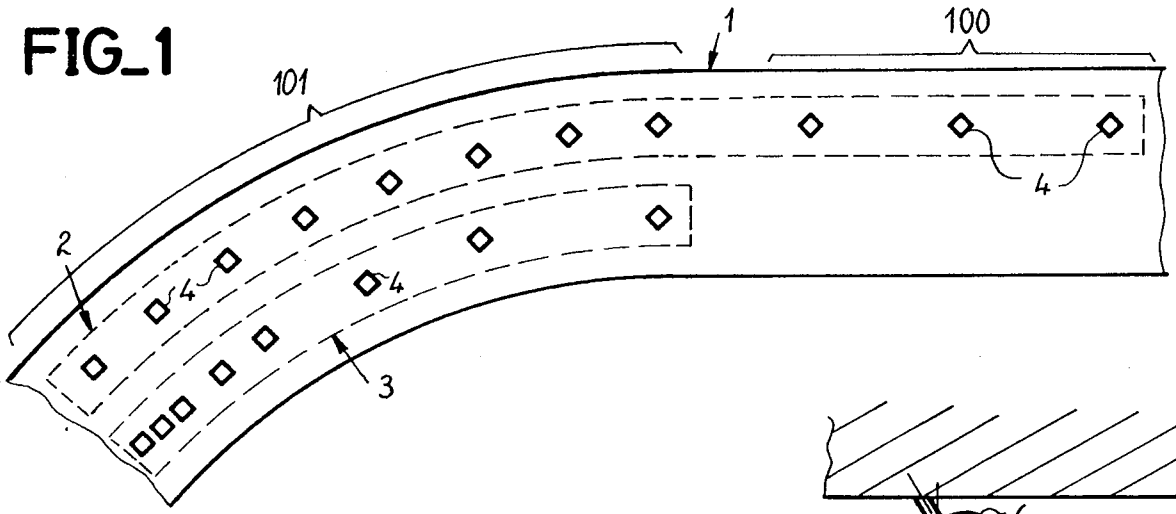
FIG. 1: A diagram relating to the installation of the beacons according to the invention.

FIG. 1 diagrammatically shows a railway track 1, which is equipped with two groups, 2, 3 of passive beacons 4. The beacons constituting a group 2 or 3 are all placed at the same distance from the rails. In the same way, the trains are equipped with means for detecting beacons 4 at distances corresponding to the locations of said beacons. In the case of FIG. 1 only two groups 2, 3 of beacons are shown but obviously a larger number of beacons can be used and this is determined by the information quantity to be transmitted to the train.

In a constructional variant of the apparatus according to the invention, the groups 2, 3 of beacons 4 are duplicated and positioned symmetrically with respect to the axis of the track along which the vehicle travels. It is thus possible to e.g. program a different speed for each travel direction.

In an embodiment illustrated in FIG. 1, the beacons 4 of group 2 are e.g. used for regulating the speed of a train. Along the straight line 100 a long distance between the beacons 4 ensures a high speed of the train. However, in the bend 101, the closing up of the beacons controls the slowing down of the train. Beacons 4 of group 3 e.g. control the stopping of the train.

Whether the particular beacon belongs to group 2 or to group 3 or to groups 2 and 3 is electrically controlled as, for example, by an electrical signal travelling within the rail.

Figure 2:
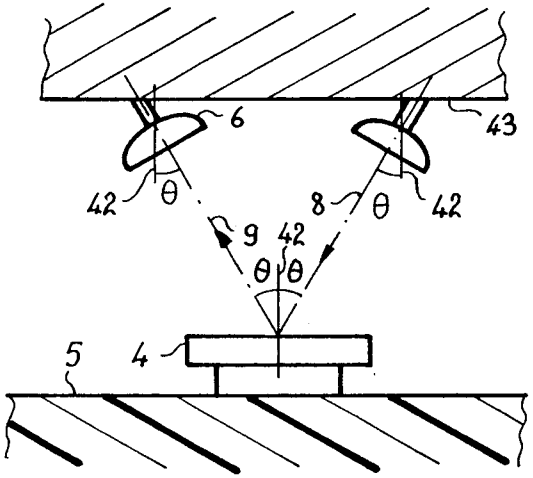
FIGS. 2 to 6: The relative arrangement of the antennas and beacons.

FIG. 2 shows a first embodiment of the apparatus according to the invention having two antennas 6 inclined by an angle $\theta$ with respect to plane 42. By definition plane 42 is a plane perpendicular to the velocity or speed vector of vehicle 43. In the case where the vehicle 43 travels horizontally, plane 42 is vertical. Antennas 6 are fixed to train 43. Beacon 4 is fixed to the ground 5, e.g. between the not shown rails. Electromagnetic waves are transmitted by the transmitting antenna along axis 8 thereof and are reflected by beacon 4 along axis 9 of the receiving antenna. The use of a transmitting antenna and a separate receiving antenna makes it possible to obtain a good decoupling between the transmitted signal and the received signal.

Figure 9:
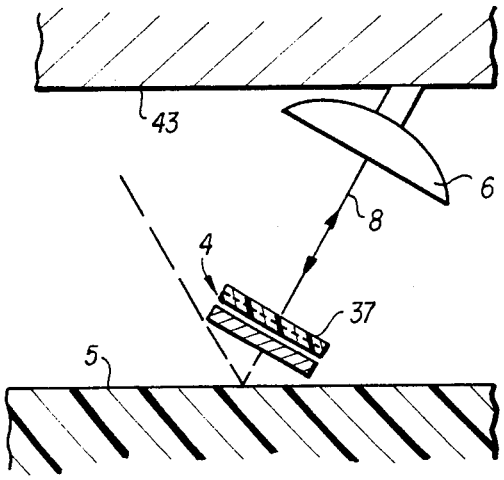
FIG. 9: A illustration of an arrangement including the polization rotating metal wires.

When there is no beacon, part of the energy from the transmitting antenna is reflected by the ground towards the receiving antenna. The energy quantity reflected by the ground is much smaller than that reflected by the beacon. However, in order to increase the signal noise ratio, the reception operation takes place with a polarization orthogonal to the polarization on transmission. Thus, beacon 4 is equipped with means making it possible to rotate the polarization plane by 90°. Such a device is e.g. constituted by a netting of metal wires embedded in the plastic material, as shown by item 37 in FIG. 9 placed in front of a reflecting metal plate. Thus, the echos reflected by such a beacon will have a polarization orthogonal to the transmitted polarization. However, the radiation reflected by the ground will mainly have the same polarization as the transmitted radiation.

Figure 3:
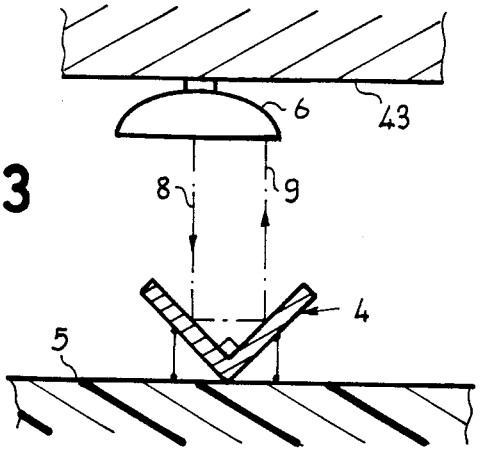

In FIG. 3 an embodiment of the apparatus according to the invention has a single transmitting-receiving antenna 6 positioned vertically above a beacon 4 ensuring the polarization rotation of the transmitted radiation. Beacon 4 has e.g. the same structure as beacon 4 in FIG. 2. Advantageously, beacon 4 has two metal plates forming a dihedron. It is well known that a dihedron leads to the polarization rotation of the electromagnetic radiation received. The edge of the dihedron is contained in the bisecting plane with respect to the polarization planes.

Figure 4:
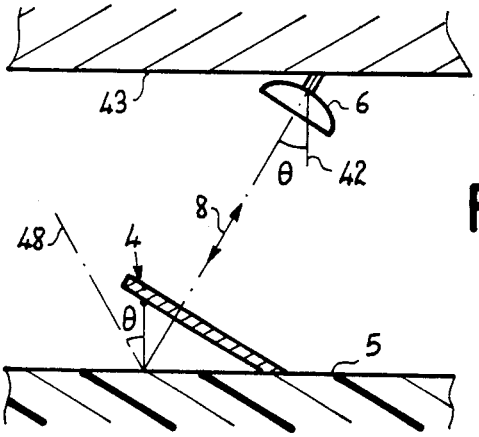
Figure 8:
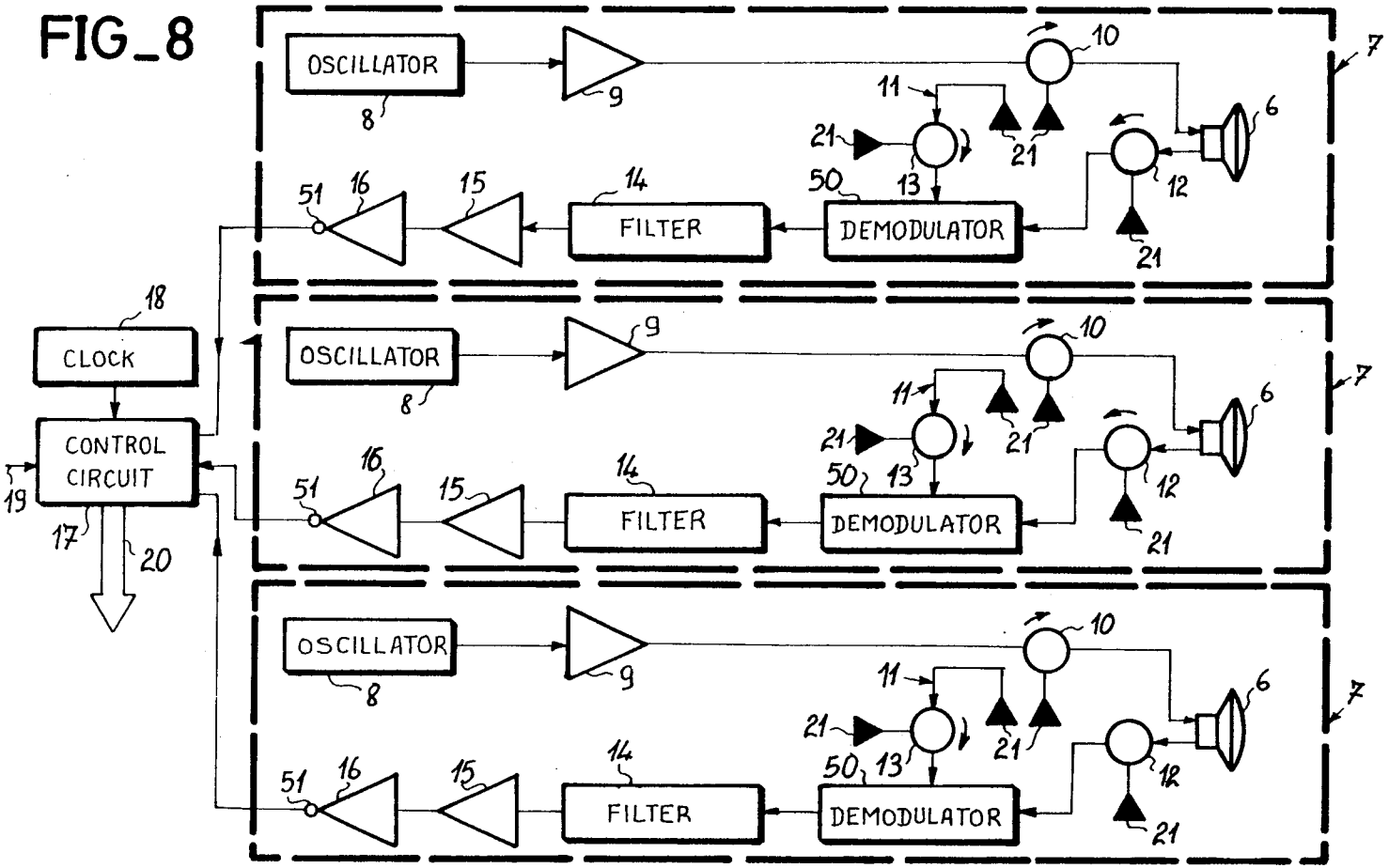
FIG. 8: A diagram of a second embodiment of the apparatus according to the invention.

FIG. 4 shows an apparatus according to the invention having a single transmitting - receiving antenna 6 inclined by an angle $\theta$ with respect to plane 42. Beacon 4 has a reflecting plane positioned perpendicularly to the axis 8 of antenna 6. The use of an inclined electromagnetic energy beam makes it possible to take advantage of the Doppler effect for improving the decoupling between the energy transmitted and the energy received by antenna 6. The Doppler frequency $f_D$ is given by the formula:

$$f_D=(2v \sin \theta)/\lambda$$

in which v is the speed of the train and λ the wavelength used. For this purpose it is merely necessary to demodulate the signal received by the signal of the same frequency as the transmitted signal and to filter by means of a high-pass filter. Such an embodiment is illustrated in FIG. 8.

In the case of the embodiment illustrated in FIG. 4, the signal-clutter ratio is improved by using an inclined beam associated with a retrodirectional beacon 4. The signals reflected by the ground in the absence of a beacon take a direction 48 differing from axis 8 of antenna 6.

Figure 5:
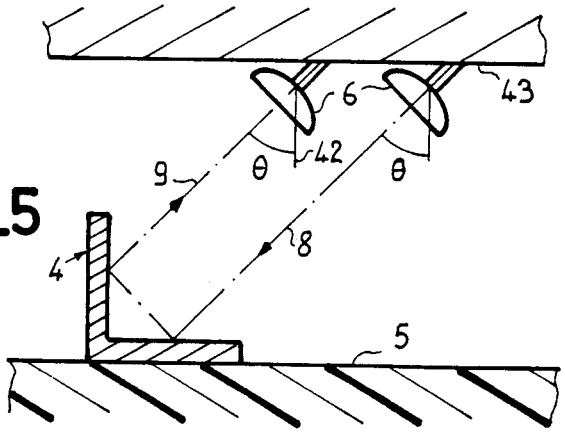

FIG. 5 shows an embodiment of the apparatus according to the invention having a transmitting antenna 6 and a receiving antenna 6 inclined by an angle θ with respect to the plane 42 and associated with retrodirection beacon 4. Thus, it is advantageous to use the Doppler effect for further improving the decoupling between transmission and reception provided by two separate antennas. Moreover, the use of a dihedron as a beacon 4 ensuring the polarization rotation makes it impossible to improve the transmission - reception decoupling, as well as the signal-clutter ratio.

Figure 6:
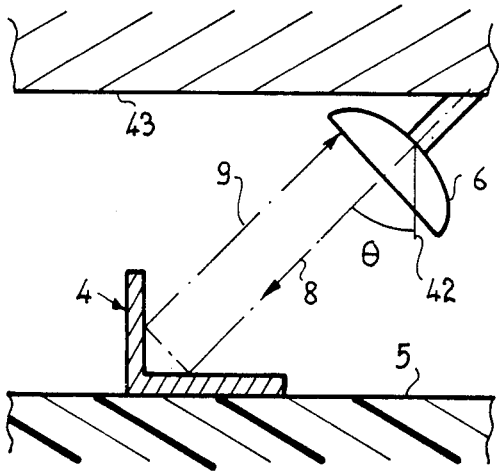

FIG. 6 shows an embodiment of the apparatus according to the invention having a single transmitting - receiving antenna 6 inclined by an angle θ with respect to plane 42 and associated with a retrodirectional beacon 4. Advantageously beacon 4 ensures the polarization rotation of the waves received. The use of the polarization rotation associated with the use of the Doppler effect makes it possible to obtain a very good decoupling of the transmission signals relative to the reception signals. The use of a single antenna makes it possible to reduce the costs and overall dimensions of the system.

The edge of the dihedron forming a beacon 4 is advantageously not parallel to the plane of the ground 5. The use of such an edge makes it possible to overcome the polarization rotation generated by the dihedrons present on the track, e.g. the ballast supporting the rails.

The use of a dihedron as a reflecting beacon increases the alignment tolerances of beacon and antenna. Thus, the axis of the energy reflected on a dihedron, whose walls are perpendicular is parallel to the axis of the incident energy. It is therefore possible to use in addition to the fixed beacons, beacons whose presence or orientation can be remotely controlled. Such beacons can e.g. order the slowing down or stopping of a train in the case of an accident on the track.

Figure 7:
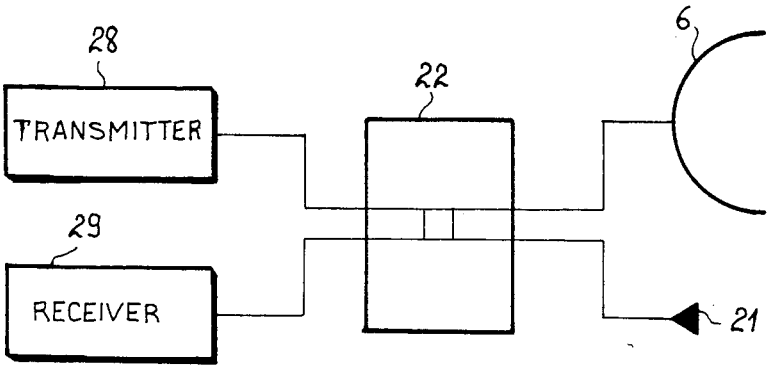
FIG. 7: A diagram of a first embodiment of the beacon detection means.

FIG. 7 shows a first embodiment of the radar according to the invention, which has a single transmitting - receiving antenna 6, a transmitter 28, a receiver 29, as well as a hybrid coupling ring 22 between antenna, transmitter and receiver. The fourth output of hybrid ring 22 is coupled to a matched load 21. However, such a coupling has the disadvantage of requiring a good matching of the antenna with transmitter 28 and receiver 29. Moreover the coupling by hybrid ring or magic-T leads to a loss of six decibels of power.

FIG. 8 shows an embodiment of the radar according to the invention having three transmission - reception groups 7 corresponding to three groups of beacons on the ground. It is obvious that the number of transmitter - receiver groups 7 is not limited to three and is determined by the amount of information which it is wished to transmit to the train. In the case where the number of different radar groups 7 required could lead to electromagnetic couplings between different groups 7, it is advantageous to use different beacon orientation and/or different working frequencies. Each transmitting - receiving group 7 has an oscillator 8 and an amplifier 9 connected to a circulator 10 connected to antenna 6. On reception, antenna 6 is connected to a circulator 12, to a demodulator 50, to a Doppler filter 14, to a low frequency amplifier 15 and to a threshold amplifier 16. In addition, a directional coupler 11 takes energy at the output of amplifier 9 and supplies it to demodulator 50. Directional coupler 11 has a circulator 13. Circulators 10, 12, 13 make it possible to insulate the remainder of the circuit from the standing waves. These are, for example, ferrite circulators. Circulators 10, 12, 13, as well as the directional coupler 11 are in each case connected to a matching load 21. Advantageously oscillator 8 is a transistor oscillator. Doppler filter 14 is a high-pass filter stopping the continuous component of the signal resulting from the demodulation. At its output, the threshold amplifier 16 has a fixed amplitude signal in the case where the signal applied to its input exceeds a fixed threshold. In the opposite case, the threshold amplifier 16 does not have an electrical signal at its output. Thus, the detection of a beacon leads to the instantaneous presence of a positive signal at the output of group 7.

In the case where it was wished to operate with negative logic, i.e. having a continuous electrical signal except during the detections of beacons 4 of FIGS. 1 to 6, the output of amplifier 16 is connected to a logic NOT gate 51.

The outputs of the transmitting - receiving group 7 are connected to a control circuit 17. The latter is connected to a clock 18 and to a control line 19. Control line 19 indicates to the control circuit 17 e.g. which transmitting - receiving groups 7 are to be validated. Control circuit 17 is, for example, a logic circuit. Advantageously the control circuit 17 is a programmable circuit, e.g. a microprocessor. Control circuit 17 transmits instructions by a control bus 20 to the various devices under its control. Simultaneously control circuit 17 supplies informations to the display panel on board the train and/or to the control system outside the train. Bus 20 is connected to interfaces and/or digital - analog converters necessary for operating the control devices.

Moreover, the use of the Doppler effect makes it possible to determine the speed of vehicle 43 relative to the ground 5. For example, demodulator 50 is connected to not shown, frequency-staged band-pass filters. The filter at whose output the signal is present indicates the speed of vehicle 43.

In an embodiment of the apparatus to the invention use is made of a frequency of 10 GHz, beacons 4 with a width of 8 cm and transmitting, transmitting - receiving and/or receiving antennas having dielectric lenses. The antenna 6 has two cross-polarization inputs, one being connected to circulator 10 and the other to circulator 12. Advantageously continuous transmission radars are used.

The invention more particularly applies to the control of guided vehicles, such as e.g. trains or subways.

What is claimed is:

1. An apparatus for the control of guided vehicles, comprising:

a plurality of electromagnetic wave reflecting beacons fixed to a track on which said guided vehicles travel wherein said beacons are arranged on said track in such a manner as to provide an indication of speed control of said guided vehicles; and means for detecting said beacons, said means being fixed to the vehicle wherein said means for detecting includes a transmitting antenna, whose radiation axis has a non-zero angle $\theta$ with the plane perpendicular to the speed vector of the vehicle;

control circuit means connected to said means for detecting said beacons in order to control said guided vehicle.

2. An apparatus according to claim 1, wherein the beacons are retrodirectional.

3. An apparatus according to claim 3, wherein a hybrid ring ensures decoupling between transmission and reception.

4. An apparatus according to claim 1, wherein the electromagnetic wave transmitting - receiving device has a single antenna for transmission and reception.

5. An apparatus according to claim 1, wherein the beacon comprises a device which rotates the polarization.

6. An apparatus according to claim 5, wherein the beacons have nettings of parallel metal wires.

7. An apparatus according to claim 5, wherein the beacons comprise dihedrons.

8. An apparatus according to claim 1, wherein the beacon detection device has a continuous transmission radar.

9. An apparatus according to claim 1 comprising a demodulator, whereof a first input receives the signals intercepted by the antenna and a second input receives the transmission signals taken by a coupler.

10. An apparatus according to claim 1, wherein the control circuit has a microprocessor.

11. An apparatus according to claim 1, comprising a clock connected to the control circuit.

12. An apparatus according to claim 1, wherein the beacon detection device has a threshold amplifier.

13. An apparatus according to claim 12, comprising a NOT gate connected to the output of the threshold amplifier.

* * * * *